US008534818B2

(12) United States Patent
Mehta et al.

(10) Patent No.: US 8,534,818 B2
(45) **Date of Patent: *Sep. 17, 2013**

(54) PRINTHEAD INCLUDING PARTICULATE TOLERANT FILTER

(75) Inventors: Rajesh V. Mehta, Rochester, NY (US); Ali G. Lopez, Pittsford, NY (US); Kam C. Ng, Rochester, NY (US); Hrishikesh V. Panchawagh, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 514 days.

This patent is subject to a terminal disclaimer.

(21) Appl. No.: 12/767,822

(22) Filed: Apr. 27, 2010

(65) Prior Publication Data

US 2011/0261123 A1 Oct. 27, 2011

(51) Int. Cl.
*B41J 2/175* (2006.01)

(52) U.S. Cl.
USPC ..... 347/93

(58) Field of Classification Search
USPC ..... 347/54, 65, 66, 67, 93
See application file for complete search history.

(56) References Cited

U.S. PATENT DOCUMENTS

| | | | | |
|---|---|---|---|---|
| 4,068,241 | A | 1/1978 | Yamada | |
| 4,636,808 | A | 1/1987 | Herron | |
| 4,638,327 | A | 1/1987 | Sutera et al. | |
| 4,639,748 | A | 1/1987 | Drake et al. | |
| 5,124,717 | A | 6/1992 | Campanelli et al. | |
| 5,141,596 | A | 8/1992 | Hawkins et al. | |
| 5,204,690 | A | 4/1993 | Lorenze, Jr. et al. | |
| 5,489,930 | A | 2/1996 | Anderson | |
| 5,691,753 | A | 11/1997 | Hilton | |
| 6,079,821 | A | 6/2000 | Chwalek et al. | |
| 6,086,195 | A * | 7/2000 | Bohorquez et al. | 347/93 |
| 6,234,623 | B1 | 5/2001 | Drake | |
| 6,264,309 | B1 | 7/2001 | Sullivan | |
| 6,267,251 | B1 | 7/2001 | Sullivan | |
| 6,280,643 | B1 | 8/2001 | Silverbrook | |
| 6,457,807 | B1 | 10/2002 | Hawkins et al. | |
| 6,491,362 | B1 | 12/2002 | Jeanmaire | |
| 6,505,921 | B2 | 1/2003 | Chwalek et al. | |
| 6,554,410 | B2 | 4/2003 | Jeanmaire et al. | |
| 6,575,566 | B1 | 6/2003 | Jeanmaire et al. | |
| 6,582,064 | B2 | 6/2003 | Cruz-Uribe et al. | |
| 6,583,350 | B1 | 6/2003 | Gee et al. | |
| 6,588,888 | B2 | 7/2003 | Jeanmaire et al. | |

(Continued)

FOREIGN PATENT DOCUMENTS

| | | |
|---|---|---|
| EP | 901 906 | 3/1999 |
| EP | 1 095 776 | 10/2006 |

*Primary Examiner* — Anh T. N. Vo
(74) *Attorney, Agent, or Firm* — William R. Zimmerli

(57) ABSTRACT

A printhead includes a nozzle plate, a filter, and a plurality of walls. Portions of the nozzle plate define a plurality of nozzles. The filter, for example, a filter membrane, includes a plurality of pores grouped in a plurality of pore clusters. Each of the plurality of walls extends from the nozzle plate to the filter membrane to define a plurality of liquid chambers positioned between the nozzle plate and the filter membrane. Each liquid chamber of the plurality of liquid chambers is in fluid communication with a respective one of the plurality of nozzles. Each liquid chamber of the plurality of liquid chambers is in fluid communication with the plurality of pores of a respective one of the plurality of pore clusters. The respective one of the plurality of pore clusters includes two pore subclusters spaced apart from each other by a non-porous portion of the filter membrane.

13 Claims, 10 Drawing Sheets

(56) References Cited

U.S. PATENT DOCUMENTS

| | | | | |
|---|---|---|---|---|
| 6,626,522 | B2 | 9/2003 | Rapp et al. | |
| 6,793,328 | B2 | 9/2004 | Jeanmaire | |
| 6,827,429 | B2 | 12/2004 | Jeanmaire et al. | |
| 6,851,796 | B2 | 2/2005 | Jeanmaire et al. | |
| 6,905,619 | B2 | 6/2005 | Kawamura et al. | |
| 6,916,090 | B2 | 7/2005 | Valley et al. | |
| 6,923,530 | B2 | 8/2005 | Anderson et al. | |
| 6,943,037 | B2 | 9/2005 | Anagnostopoulos et al. | |
| 7,101,030 | B2 | 9/2006 | Clark et al. | |
| 7,121,643 | B2 * | 10/2006 | Yamada | 347/20 |
| 7,192,131 | B2 * | 3/2007 | Gao et al. | 347/93 |
| 7,431,444 | B2 * | 10/2008 | Ito | 347/93 |
| 7,484,835 | B2 * | 2/2009 | Kim et al. | 347/67 |
| 7,607,766 | B2 | 10/2009 | Steiner | |
| 8,201,928 | B2 * | 6/2012 | Gerner et al. | 347/71 |
| 2004/0012662 | A1 | 1/2004 | Kneezel et al. | |
| 2004/0179073 | A1 | 9/2004 | Valley et al. | |
| 2005/0018022 | A1 | 1/2005 | Studer et al. | |
| 2005/0151798 | A1 | 7/2005 | Merz et al. | |
| 2011/0261124 | A1 * | 10/2011 | Baumer et al. | 347/93 |

* cited by examiner

PRINTHEAD INCLUDING PARTICULATE TOLERANT FILTER

CROSS REFERENCE TO RELATED APPLICATIONS

Reference is made to commonly-assigned, U.S. patent application Ser. No. 12/767,824, entitled "PRINTHEAD INCLUDING FILTER ASSOCIATED WITH EACH NOZZLE", Ser. No. 12/767,826, entitled "CONTINUOUS PRINTHEAD INCLUDING POLYMERIC FILTER", Ser. No. 12/767,828, entitled "METHOD OF MANUFACTURING PRINTHEAD INCLUDING POLYMERIC FILTER", Ser. No. 12/767,827, entitled "PRINTHEAD INCLUDING POLYMERIC FILTER", all filed concurrently herewith.

FIELD OF THE INVENTION

This invention relates generally to the field of digitally controlled printing systems and, in particular, to the filtering of liquids that are subsequently emitted by a printhead of the printing system.

BACKGROUND OF THE INVENTION

The use of inkjet printers for printing information on recording media is well established. Printers employed for this purpose can include continuous printing systems which emit a continuous stream of drops from which specific drops are selected for printing in accordance with print data. Other printers can include drop-on-demand printing systems that selectively form and emit printing drops only when specifically required by print data information.

Continuous printer systems typically include a printhead that incorporates a liquid supply system and a nozzle plate having a plurality of nozzles fed by the liquid supply system. The liquid supply system provides the liquid to the nozzles with a pressure sufficient to jet an individual stream of the liquid from each of the nozzles. The fluid pressures from the liquid supply required to form the liquid jets in a continuous inkjet are typically much greater than the fluid pressures from the liquid supply employed in drop-on-demand printer systems.

Different methods known in the art have been used to produce various components within a printer system. Some techniques that have been employed to form micro-electro-mechanical systems (MEMS) have also been employed to form various printhead components. MEMS processes typically include modified semiconductor device fabrication technologies. Various MEMS processes typically combine photo-imaging techniques with etching techniques to form various features in a substrate. The photo-imaging techniques are employed to define regions of a substrate that are to be preferentially etched from other regions of the substrate that should not be etched. MEMS processes can be applied to single layer substrates or to substrates made up of multiple layers of materials having different material properties. MEMS processes have been employed to produce nozzle plates along with other printhead structures such as ink feed channels, ink reservoirs, electrical conductors, electrodes and various insulator and dielectric components.

Particulate contamination in a printing system can adversely affect quality and performance, especially in printing systems that include printheads with small diameter nozzles. Particulates present in the liquid can either cause a complete blockage or partial blockage in one or more nozzles. Some blockages reduce or even prevent liquid from being emitted from printhead nozzles while other blockages can cause a stream of liquid jetted from printhead nozzles to be randomly directed away from its desired trajectory. Regardless of the type of blockage, nozzle blockage is deleterious to high quality printing and can adversely affect printhead reliability. This becomes even more important when using a page wide printing system that accomplishes printing in a single pass. During a single pass printing operation, usually all of the printing nozzles of a printhead are operational in order to achieve a desired image quality and ink coverage on the receiving media. As the printing system has only one opportunity to print a given section of media, image artifacts can result when one or more nozzles are blocked or otherwise not working properly.

Conventional printheads have included one or more filters positioned at various locations in the fluid path to reduce problems associated with particulate contamination. Even so, there is an ongoing need to reduce particulate contamination in printheads and printing systems and an ongoing need for printhead filters that provide adequate filtration with acceptable levels of pressure loss across the filter. There is also an ongoing need for effective and practical methods for forming printhead filters using MEMS fabrication techniques.

SUMMARY OF THE INVENTION

According to one aspect of the present invention, a printhead includes a nozzle plate, a filter, and a plurality of walls. Portions of the nozzle plate define a plurality of nozzles. The filter, for example, a filter membrane, includes a plurality of pores grouped in a plurality of pore clusters. Each of the plurality of walls extends from the nozzle plate to the filter membrane to define a plurality of liquid chambers positioned between the nozzle plate and the filter membrane. Each liquid chamber of the plurality of liquid chambers is in fluid communication with a respective one of the plurality of nozzles. Each liquid chamber of the plurality of liquid chambers is in fluid communication with the plurality of pores of a respective one of the plurality of pore clusters. The respective one of the plurality of pore clusters includes two pore sub-clusters spaced apart from each other by a non-porous portion of the filter membrane.

According to another aspect of the invention, the printhead can include a liquid source that is in liquid communication with each nozzle of the plurality of nozzles through each liquid chamber and the respective one of the plurality of pore clusters associated with each liquid chamber. The liquid source is configured to provide liquid under pressure sufficient to eject a jet of liquid through each nozzle.

BRIEF DESCRIPTION OF THE DRAWINGS

In the detailed description of the example embodiments of the invention presented below, reference is made to the accompanying drawings, in which.

DETAILED DESCRIPTION

Figure 1:
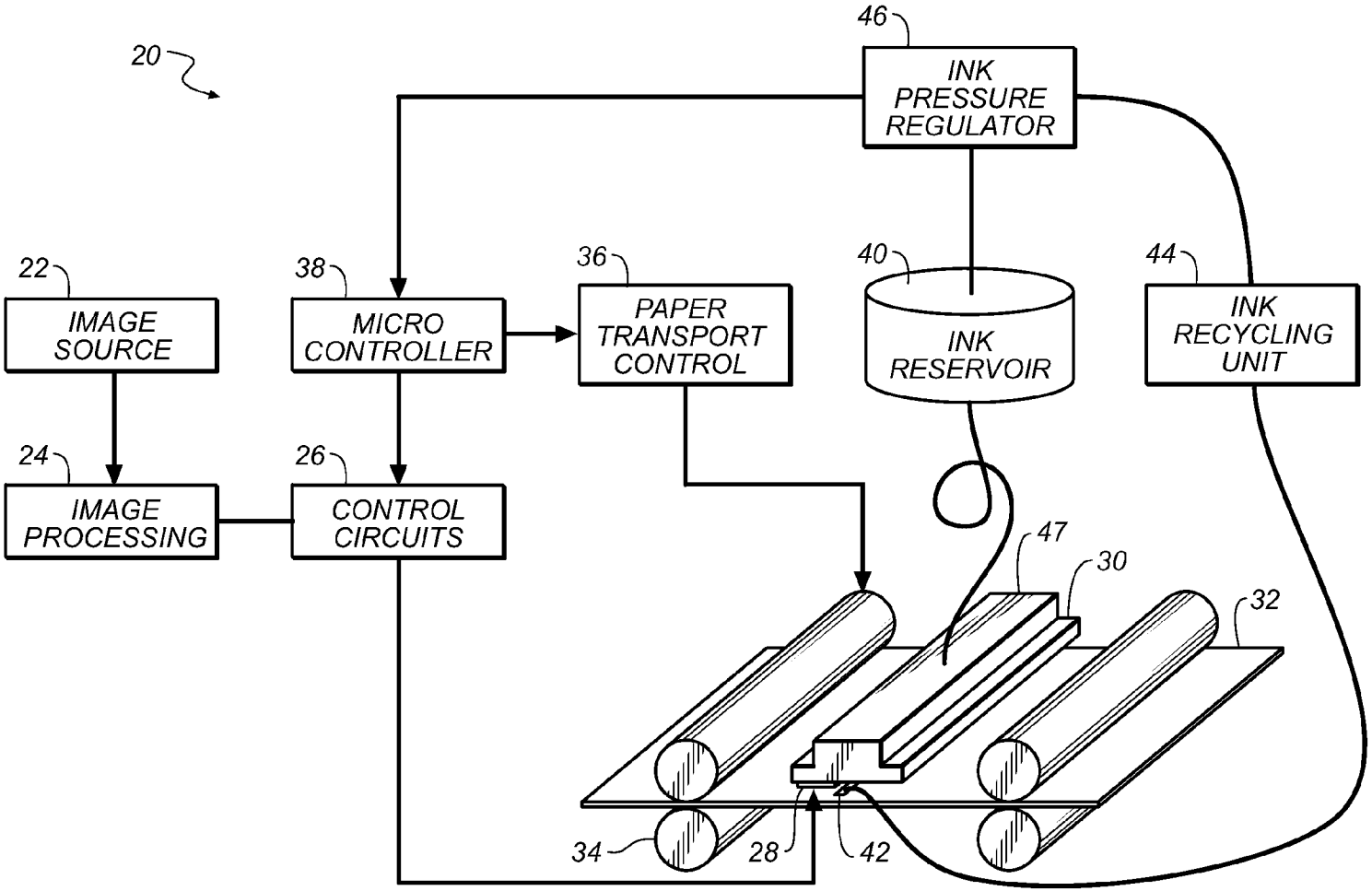
FIG. 1 shows a simplified schematic block diagram of an example embodiment of a printing system made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a printhead or printhead components typically used in inkjet printing systems. However, many other applications are emerging which use inkjet printheads to emit liquids (other than inks) that need to be finely metered and deposited with high spatial precision. As such, as described herein, the terms "liquid" and "ink" refer to any material that can be ejected by the printhead or printhead components described below.

Figure 2:
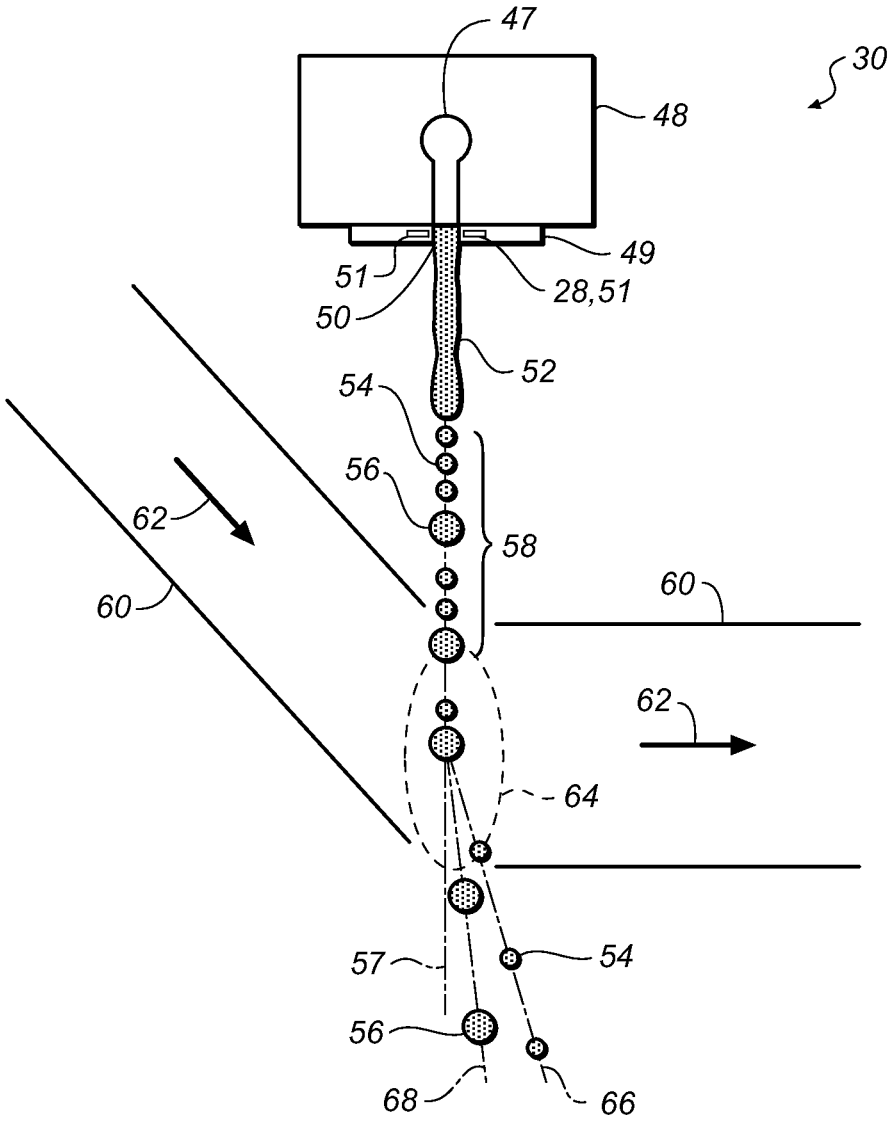
FIG. 2 is a schematic view of an example embodiment of a continuous printhead made in accordance with the present invention.
Figure 3:
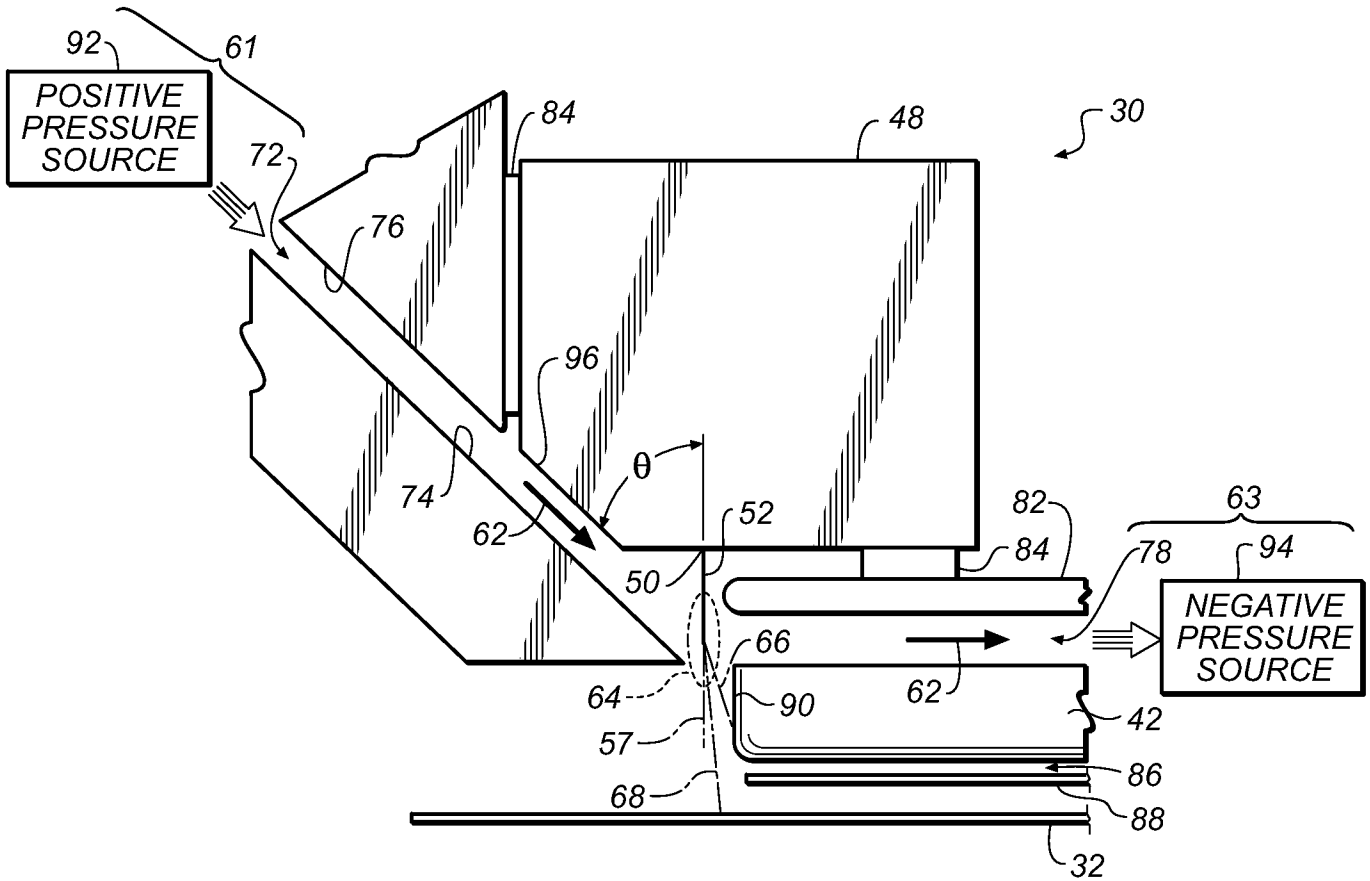
FIG. 3 is a schematic view of an example embodiment of a continuous printhead made in accordance with the present invention.

Referring to FIGS. 1-3, example embodiments of a printing system and a continuous printhead are shown that include the present invention described below. It is contemplated that the present invention also finds application in other types of printheads or jetting modules including, for example, drop on demand printheads and other types of continuous printheads.

Referring to FIG. 1, a continuous inkjet printing system 20 includes an image source 22 such as a scanner or computer which provides raster image data, outline image data in the form of a page description language, or other forms of digital image data. This image data is converted to half-toned bitmap image data by an image processing unit 24 which also stores the image data in memory. A plurality of drop forming mechanism control circuits 26 read data from the image memory and apply time-varying electrical pulses to a drop forming mechanism(s) 28 that are associated with one or more nozzles of a printhead 30. These pulses are applied at an appropriate time, and to the appropriate nozzle, so that drops formed from a continuous inkjet stream will form spots on a recording medium 32 in the appropriate position designated by the data in the image memory.

Recording medium 32 is moved relative to printhead 30 by a recording medium transfer system 34, which is electronically controlled by a recording medium transfer control system 36, and which in turn is controlled by a micro-controller 38. The recording medium transfer system 34 shown in FIG. 1 is a schematic only, and many different mechanical configurations are possible. For example, a transfer roller could be used as recording medium transfer system 34 to facilitate transfer of the ink drops to recording medium 32. Such transfer roller technology is well known in the art. In the case of page width printheads, it is most convenient to move recording medium 32 past a stationary printhead. However, in the case of scanning print systems, it is usually most convenient to move the printhead along one axis (the sub-scanning direction) and the recording medium along an orthogonal axis (the main scanning direction) in a relative raster motion.

Ink is contained in an ink reservoir 40 under pressure. Unlike drop-on-demand printheads, a continuous flow of liquid 52 is provided through printhead 30, the continuous flow of liquid 52 having pressure sufficient to form the continuous jets of liquid 52 from which continuous inkjet drop streams are formed. In the non-printing state, the continuous inkjet drop streams are unable to reach recording medium 32 due to an ink catcher 42 that blocks the stream and which may allow a portion of the ink to be recycled by an ink recycling unit 44. The ink recycling unit reconditions the ink and feeds it back to reservoir 40. Such ink recycling units are well known in the art. The ink pressure suitable for optimal operation will depend on a number of factors, including geometry and thermal properties of the nozzles and thermal properties of the ink. A constant ink pressure can be achieved by applying pressure to ink reservoir 40 under the control of ink pressure regulator 46. Alternatively, the ink reservoir can be left unpressurized, or even under a reduced pressure (vacuum), and a pump is employed to deliver ink from the ink reservoir under pressure to the printhead 30. In such an embodiment, the ink pressure regulator 46 can include an ink pump control system. As shown in FIG. 1, catcher 42 is a type of catcher commonly referred to as a "knife edge" catcher.

The ink is distributed to printhead 30 through an ink channel 47. The ink preferably flows through slots or holes etched through a silicon substrate of printhead 30 to its front surface, where a plurality of nozzles and drop forming mechanisms, for example, heaters, are situated. When printhead 30 is fabricated from silicon, drop forming mechanism control circuits 26 can be integrated with the printhead. Printhead 30 also includes a deflection mechanism which is described in more detail below with reference to FIGS. 2 and 3.

Referring to FIG. 2, a schematic view of continuous liquid printhead 30 is shown. A jetting module 48 of printhead 30 includes an array or a plurality of nozzles 50 formed in a nozzle plate 49. In FIG. 2, nozzle plate 49 is affixed to jetting module 48. However, as shown in FIG. 3, nozzle plate 49 can be integrally formed with jetting module 48.

Liquid 52, for example, ink, is emitted under pressure through each nozzle 50 of the array to form streams, also commonly referred to as jets, of liquid 52. In FIG. 2, the array or plurality of nozzles extends into and out of the figure.

Jetting module 48 is operable to form liquid drops having a first size or volume and liquid drops having a second size or volume through each nozzle. To accomplish this, jetting module 48 includes a drop stimulation or drop forming device 28, for example, a heater or a piezoelectric actuator, that, when selectively activated, perturbs each stream or jet of liquid 52, for example, ink, to induce portions of each stream to break-off from the stream and coalesce to form drops 54, 56.

In FIG. 2, drop forming device 28 is a heater 51, for example, an asymmetric heater or a ring heater (either segmented or not segmented), located in a nozzle plate 49 on one or both sides of nozzle 50. This type of drop formation is known with certain aspects having been described in, for example, one or more of U.S. Pat. No. 6,457,807 B1, issued to Hawkins et al., on Oct. 1, 2002; U.S. Pat. No. 6,491,362 B1, issued to Jeanmaire, on Dec. 10, 2002; U.S. Pat. No. 6,505,921 B2, issued to Chwalek et al., on Jan. 14, 2003; U.S. Pat. No. 6,554,410 B2, issued to Jeanmaire et al., on Apr. 29, 2003; U.S. Pat. No. 6,575,566 B1, issued to Jeanmaire et al., on Jun. 10, 2003; U.S. Pat. No. 6,588,888 B2, issued to Jeanmaire et al., on Jul. 8, 2003; U.S. Pat. No. 6,793,328 B2, issued to Jeanmaire, on Sep. 21, 2004; U.S. Pat. No. 6,827,429 B2, issued to Jeanmaire et al., on Dec. 7, 2004; and U.S. Pat. No. 6,851,796 B2, issued to Jeanmaire et al., on Feb. 8, 2005.

Typically, one drop forming device 28 is associated with each nozzle 50 of the nozzle array. However, a drop forming device 28 can be associated with groups of nozzles 50 or all of nozzles 50 of the nozzle array.

When printhead 30 is in operation, drops 54, 56 are typically created in a plurality of sizes or volumes, for example, in the form of large drops 56 having a first size or volume, and small drops 54 having a second size or volume. The ratio of the mass of the large drops 56 to the mass of the small drops 54 is typically approximately an integer between 2 and 10. A drop stream 58 including drops 54, 56 follows a drop path or trajectory 57.

Printhead 30 also includes a gas flow deflection mechanism 60 that directs a flow of gas 62, for example, air, past a portion of the drop trajectory 57. This portion of the drop trajectory is called the deflection zone 64. As the flow of gas 62 interacts with drops 54, 56 in deflection zone 64, it alters the drop trajectories. As the drop trajectories pass out of the deflection zone 64 they are traveling at an angle, called a deflection angle, relative to the un-deflected drop trajectory 57.

Small drops 54 are more affected by the flow of gas than are large drops 56 so that the small drop trajectory 66 diverges from the large drop trajectory 68. That is, the deflection angle for small drops 54 is larger than for large drops 56. The flow of gas 62 provides sufficient drop deflection and therefore sufficient divergence of the small and large drop trajectories so that catcher 42 (shown in FIGS. 1 and 3) can be positioned to intercept one of the small drop trajectory 66 and the large drop trajectory 68 so that drops following the trajectory are collected by catcher 42 while drops following the other trajectory bypass the catcher and impinge a recording medium 32 (shown in FIGS. 1 and 3).

When catcher 42 is positioned to intercept large drop trajectory 68, small drops 54 are deflected sufficiently to avoid contact with catcher 42 and strike the print recording medium 32. As the small drops are printed, this is called small drop print mode. When catcher 42 is positioned to intercept small drop trajectory 66, large drops 56 are the drops that print. This is referred to as large drop print mode.

Referring to FIG. 3, jetting module 48 includes an array or a plurality of nozzles 50. Liquid, for example, ink, supplied through channel 47 (shown in FIG. 2), is emitted under pressure through each nozzle 50 of the array to form streams or jets of liquid 52. In FIG. 3, the array or plurality of nozzles 50 extends into and out of the figure.

Drop stimulation or drop forming device 28 (shown in FIGS. 1 and 2) associated with jetting module 48 is selectively actuated to perturb the stream or jet of liquid 52 to induce portions of the stream to break off from the stream to form drops. In this way, drops are selectively created in the form of large drops and small drops that travel toward a recording medium 32.

Positive pressure gas flow structure 61 of gas flow deflection mechanism 60 is located on a first side of drop trajectory 57. Positive pressure gas flow structure 61 includes first gas flow duct 72 that includes a lower wall 74 and an upper wall 76. Gas flow duct 72 directs gas flow 62 supplied from a positive pressure source 92 at downward angle θ of approximately a 45° relative to the stream of liquid 52 toward drop deflection zone 64 (also shown in FIG. 2). Optional seal(s) 84 provides an air seal between jetting module 48 and upper wall 76 of gas flow duct 72.

Upper wall 76 of gas flow duct 72 does not need to extend to drop deflection zone 64 (as shown in FIG. 2). In FIG. 3, upper wall 76 ends at a wall 96 of jetting module 48. Wall 96 of jetting module 48 serves as a portion of upper wall 76 ending at drop deflection zone 64.

Negative pressure gas flow structure 63 of gas flow deflection mechanism 60 is located on a second side of drop trajectory 57. Negative pressure gas flow structure includes a second gas flow duct 78 located between catcher 42 and an upper wall 82 that exhausts gas flow from deflection zone 64. Second duct 78 is connected to a negative pressure source 94 that is used to help remove gas flowing through second duct 78. Optional seal(s) 84 provides an air seal between jetting module 48 and upper wall 82.

As shown in FIG. 3, gas flow deflection mechanism 60 includes positive pressure source 92 and negative pressure source 94. However, depending on the specific application contemplated, gas flow deflection mechanism 60 can include only one of positive pressure source 92 and negative pressure source 94.

Gas supplied by first gas flow duct 72 is directed into the drop deflection zone 64, where it causes large drops 56 to follow large drop trajectory 68 and small drops 54 to follow small drop trajectory 66. As shown in FIG. 3, small drop trajectory 66 is intercepted by a front face 90 of catcher 42. Small drops 54 contact face 90 and flow down face 90 and into a liquid return duct 86 located or formed between catcher 42 and a plate 88. Collected liquid is either recycled and returned to ink reservoir 40 (shown in FIG. 1) for reuse or discarded. Large drops 56 bypass catcher 42 and travel on to recording medium 32. Alternatively, catcher 42 can be positioned to intercept large drop trajectory 68. Large drops 56 contact catcher 42 and flow into a liquid return duct located or formed in catcher 42. Collected liquid is either recycled for reuse or discarded. Small drops 54 bypass catcher 42 and travel on to recording medium 32.

Alternatively, deflection can be accomplished by applying heat asymmetrically to stream of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000. It is understood that these deflections are purposely created and are different than undesired deflections created by particulate contamination of a printhead filter.

Alternatively, deflection can be accomplished by applying heat asymmetrically to filament of liquid 52 using an asymmetric heater 51. When used in this capacity, asymmetric heater 51 typically operates as the drop forming mechanism in addition to the deflection mechanism. This type of drop formation and deflection is known having been described in, for example, U.S. Pat. No. 6,079,821, issued to Chwalek et al., on Jun. 27, 2000.

Deflection can also be accomplished using an electrostatic deflection mechanism. Typically, the electrostatic deflection mechanism either incorporates drop charging and drop deflection in a single electrode, like the one described in U.S. Pat. No. 4,636,808, or includes separate drop charging and drop deflection electrodes.

As shown in FIG. 3, catcher 42 is a type of catcher commonly referred to as a "Coanda" catcher. However, the "knife edge" catcher shown in FIG. 1 and the "Coanda" catcher shown in FIG. 3 are interchangeable and work equally well. Alternatively, catcher 42 can be of any suitable design including, but not limited to, a porous face catcher, a delimited edge catcher, or combinations of any of those described above.

Figure 4A:
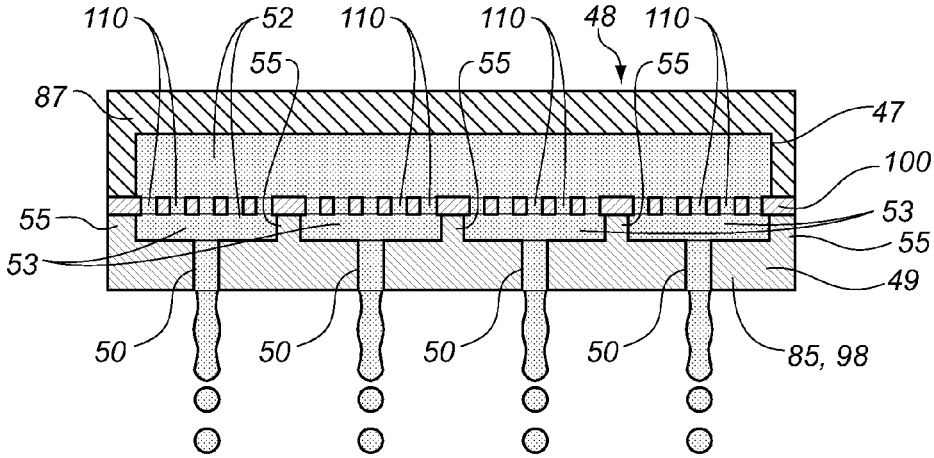
FIG. 4A is a cross-sectional side view of a jetting module including an example embodiment of the invention.

FIG. 4A is a cross-sectional side view of a jetting module 48 of printhead 30 including an example embodiment of the invention. Specifically, cross-sectional views of a nozzle plate 49 and a channel 47 are shown. For clarity, various other structures including drop forming device 28/heater 51 are not shown. In this example embodiment, channel 47 has been formed in a separate component which has been assembled into jetting module 48. Specifically, channel 47 is formed from a substrate 87.

Nozzle plate 49 is formed from a substrate 85, various portions of substrate 85 defining a plurality of nozzles 50. For clarity, only four (4) nozzles 50 are shown. It is understood that other suitable numbers of nozzles 50 can be employed in other example embodiments.

Jetting module 48 includes a filter adapted for filtering particulate matter from the continuous flow of liquid 52. In particular, jetting module 48 includes filter membrane 100. Filter membrane 100 is adapted for filtering portions of the continuous flow of liquid 52 that is provided by channel 47. Filter membrane 100 includes a plurality of pores 110 adapted for filtering particulate matter in the continuous flow of liquid 52.

Jetting module 48 includes a plurality of liquid chambers 53, each of the liquid chambers 53 providing a portion of liquid 52 to a respective one of nozzles 50. In this example embodiment, filter membrane 100 is separated from nozzles 50 by the plurality of liquid chambers 53. The liquid chambers 53 provide for fluid communication between nozzles 50 and pores 110. Each liquid chamber 53 can be positioned for fluid communication with a different one of the plurality of nozzles 50.

In this example embodiment, each liquid chamber 53 is positioned for fluid communication with a single different one of the nozzles 50. Each liquid chamber 53 is defined by a walled enclosure at leas partially defines by wall(s) 55. Each wall 55 extends from nozzle plate 49 to filter membrane 100 and helps define liquid chambers 53 that are positioned between nozzle plate 49 and filter membrane 100. In addition to being in fluid communication with a respective one of the plurality of nozzles 50, each liquid chamber 53 of the plurality of liquid chambers 53 is in fluid communication with a plurality of pores 110 of a respective one of the plurality of pore clusters 120, described in more detail below, of filter membrane 100.

Each of the walled enclosures can take various forms including walled enclosures that define circular, rectangular and elliptical spaces. Liquid chambers 53 of the present invention can provide various benefits. For example, liquid chambers 53 can be employed to reduce acoustical crosstalk between nozzles 50. The walled enclosures employed to define liquid chambers 53 can be used to provide structural support for various printhead components. Added structural support may be required to withstand the rigors of a manufacturing process by way of non-limiting example.

Figure 4B:
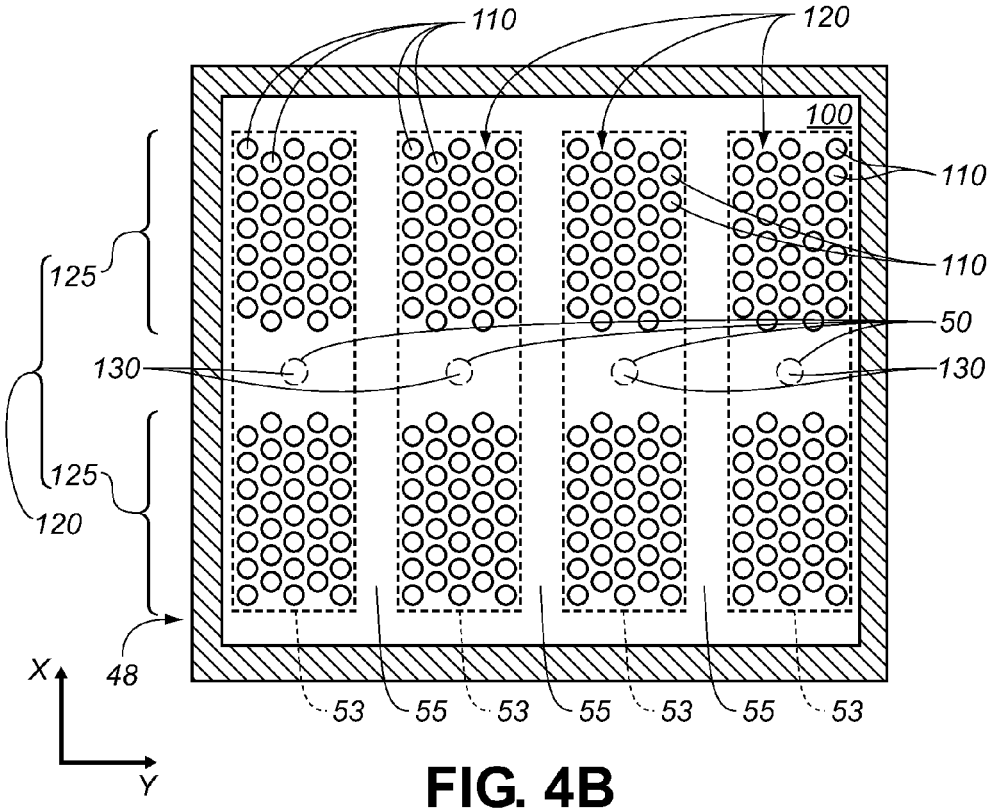
FIG. 4B is a cross-sectional plan view of a jetting module including another example embodiment of the invention.

FIG. 4B schematically shows a plan sectional view of jetting module 48 including another example embodiment of the present invention. In this example embodiment, filter membrane 100 includes a planar member positioned to span across or "bridge" the liquid chambers 53 (i.e. liquid chambers 53 and nozzles 50 being shown in broken lines). The plurality of pores 110 adapted for filtering particulate matter from the continuous flow of liquid 52 are shown positioned in the planar member. Each of the pores 110 can include various sectional shapes suitable for filtering the continuous flow of liquid 52. For example, pores 110 including circular sectional shapes are shown. The size of the pores 110 can vary in accordance with a measured or anticipated size of particulate manner within liquid 52. Circular shaped pores 110 can include diameters on the order of four (4) microns although other pore shapes, sizes, and pore arrangement patterns are permitted. In some example embodiments, pores 110 are sized such that an area of each pore 110 is less than half of the area of each nozzle 50. In the illustrated embodiment, each of the plurality of pores 110 has a uniform size when compared to other pores of the plurality of pores 110. Each pore 110 forms an opening through filter membrane 100. The path of the continuous flow of liquid 52 flowing within each pore 110 is parallel to a path of the continuous flow of liquid 52 within each of the nozzles 50. Reference axis X and Y are provided for convenience. In this case, axis Y is oriented along the axis of the array of nozzles 50 and axis X is arranged orthogonally to this direction. In some example embodiments, axis X is arranged along a relative movement direction between recording medium 32 and printhead 30. The relative movement direction can be associated with the direction of a moving web, for example.

Figure 5A:
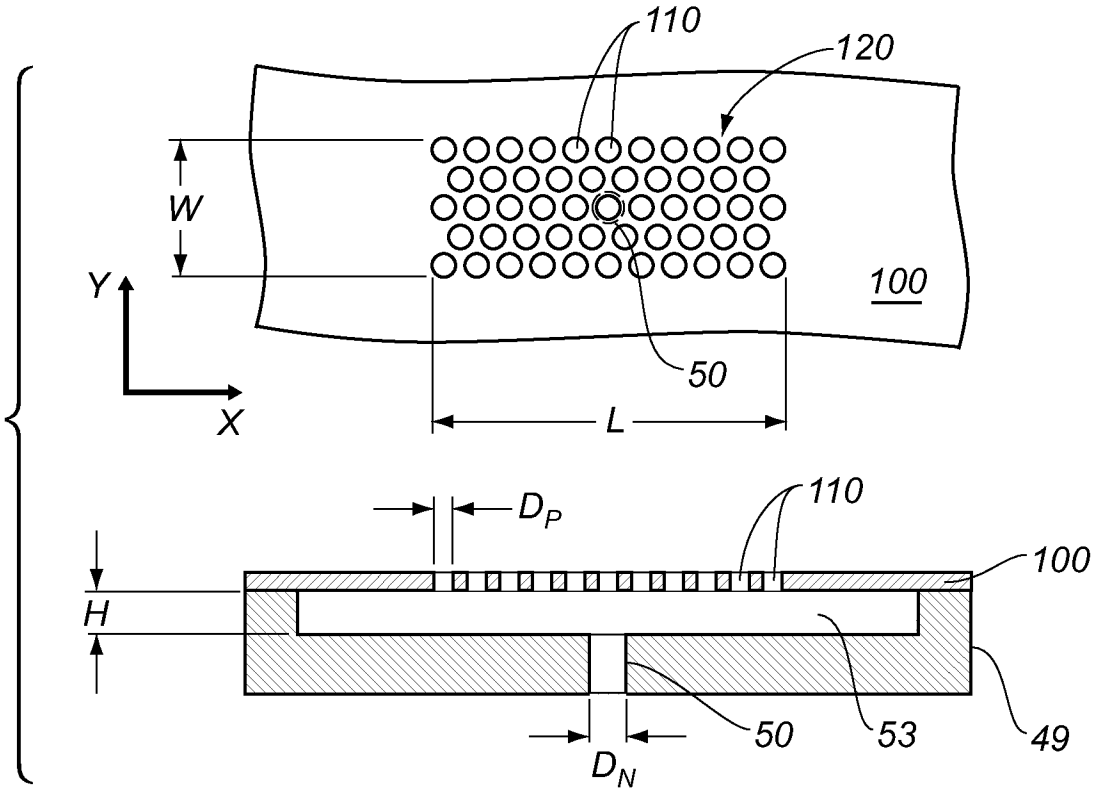
FIG. 5A shows sectional plan and side views of a nozzle, a liquid chamber and a portion of a filter membrane including an example embodiment of a pore cluster configuration according to the present invention.
Figure 5B:
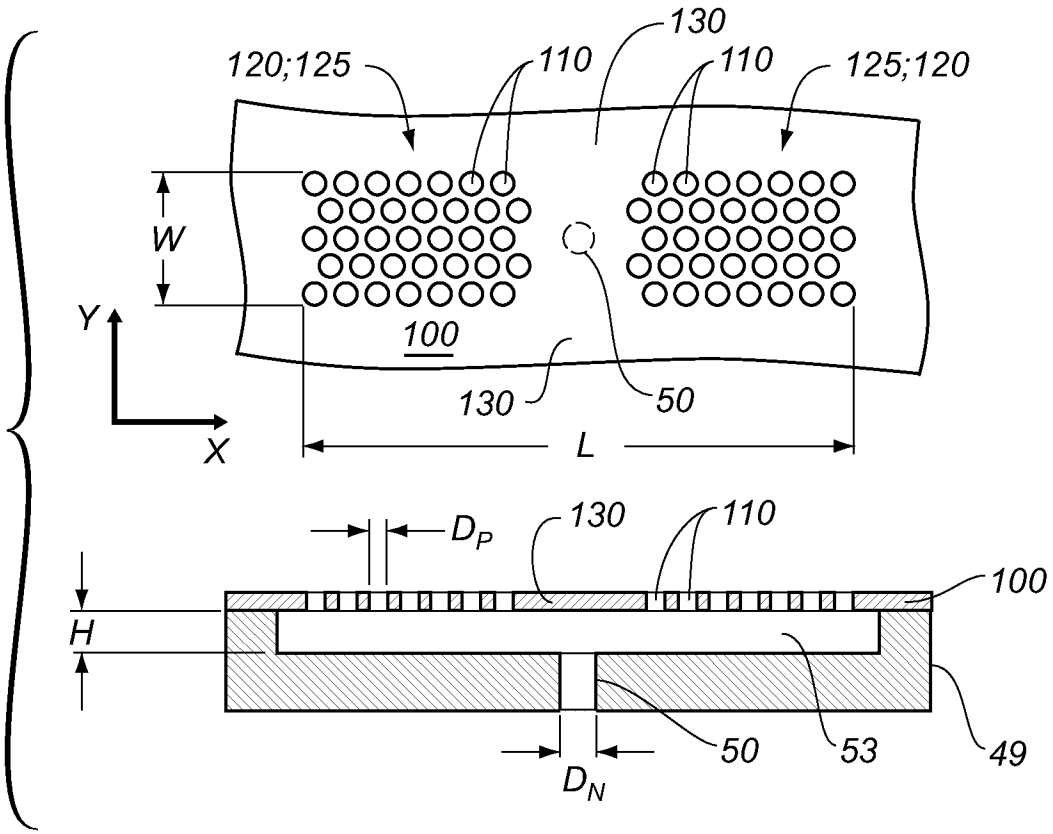
FIG. 5B shows sectional plan and side views of a nozzle, a liquid chamber and a portion of a filter membrane including another example embodiment of a pore cluster configuration according to the present invention.

Referring additionally to FIGS. 5A and 5B, pores 110 are grouped together in various pore clusters 120. Each of the pores clusters 120 is associated with a respective one of the nozzles 50. A pore cluster 120 can include a plurality of pore sub-clusters 125 associated with each of the nozzles 50. The pores 110 within a pore cluster 120 can be arranged in either a regular or a random pattern. Each cluster 120 is positioned to allow fluid 52 to flow under pressure through the pores 110 of the cluster 120 into an associated fluid chamber 53 and finally into an associated nozzle 50 from which the fluid 52 is jetted. It is understood that each cluster 120 is not limited to two pore sub-clusters 125 and can include other suitable numbers of pore sub-clusters 125 in other embodiments of the invention.

Pores 110 in each pore cluster 120 are regularly arranged. As shown in FIG. 5A, one or more of the pore clusters 120 is positioned such that a pore 110 overlaps a nozzle 50 when viewed in the direction of fluid flow through the nozzle 50. As shown in FIGS. 4B and 5B, each pore cluster 120 is separated from another of the pore clusters 120 in an associated sub-cluster 125 by a non-porous portion 130 of filter membrane 100. The non-porous portions 130 are positioned collinearly with the associated one of the nozzles 50 while none of the pores 110 in each sub-cluster 125 are positioned collinearly with the associated one of the nozzles 50. Each of the pore clusters 120 in a given sub-cluster 125 is symmetrically located relative to an associated nozzle 50.

The number and size of the pores 110 employed in each pore cluster 120 can vary in various embodiments of the invention. Typically, each of the pore clusters 120 includes a sufficient number of pores 110 to allow a small number of pores in the pore cluster to become obstructed during filtering without adversely affecting the flow of liquid from the nozzle 50. The number of pores 110 employed can be tailored to account for the flow impedance through the pores 110 and therefore the pressure drop across the thermal stimulation membrane 100 even if a small number of pores in the pore cluster become obstructed. A suitable number of the pores 110 can be determined on the basis of a measured or predicted quantity of particulates in liquid 52. Pressure drops will arise as the continuous flow of liquid 52 flows through the pores 110 of filter membrane 100. It is desired that these pressure drops be reduced as much a possible. Factors including the number and size of the pores 110 employed, the number of pores 110 that are expected to be obstructed during filtering, and the thickness of filter membrane 110 can have a bearing on the pressure drops that are encountered during the operation of printhead 30. In some example embodiments, a size of the pores 110 when viewed in a plane perpendicular to a direction of the path of the continuous flow of the liquid 52 through each pore 110 in a sub-cluster 125 is selected so that a pressure drop through the pores 110 of the sub-cluster 125 is less than $1/5^{th}$ of a pressure drop through an associated nozzle 50. In some example embodiments, a thickness of filter membrane 100 is selected so that a pressure drop through the pores 110 of a sub-cluster 125 is less than $1/5^{th}$ of a pressure drop through an associated nozzle 50.

A degree to which a jet of liquid 52 that is emitted from a nozzle 50 maintains a desired orientation is typically referred to as "jet straightness". Jet straightness is of paramount importance as it pertains to the quality of images produced by continuous inkjet printing systems. In some cases, a jet deflection no greater than 0.50 degrees is preferred. In other cases, a jet deflection no greater than 0.25 degrees is preferred. In yet other cases, a jet deflection no greater than 0.05 degrees or less is most preferred. Various factors can cause undesired jet deflections deviations from a desired jet straightness requirement. For example, an obstruction of the various pores 110 of filter membrane 100 can lead to undesired deflections in the jets of liquid 52 that are emitted from various ones of the nozzles 50. It has been determined that the separation between filter membrane 100 and nozzle plate 49 can have a significant effect on jet straightness when various ones of the pores 110 become obstructed by particulate matter in fluid 52. This effect can become especially pronounced when these separations are on the order of several microns as would be the case when the nozzle plate 49 and filter membrane 100 are formed as an integrated unit by the use of MEMS techniques.

Referring to FIGS. 5A and 5B, sectional plan and side views of a nozzle 50 and a portion of a filter membrane 100 having a particular configuration of pore cluster 120 are shown. Each of the sectional plan views are referenced by axis X and Y which are arranged as previously defined. FIG. 5A shows a pore cluster 120 configuration including a plurality of pores 110 arranged in a uniform fashion over a liquid chamber 53 and nozzle 50. In this case, the pores 110 are uniformly arranged across a distance L along the X axis and a distance W along the Y axis. In FIG. 5A, one or more of pores 110 in pore cluster 120 overlap nozzle 50 (shown in broken lines). In FIG. 5B, a pore cluster 120 configuration includes two pore sub-clusters 125 separated from each other along the X axis by a non-porous portion 130 of the filter membrane 100. In this case, the pores 110 arranged across a distance L along the X axis and a distance W along the Y axis. In this case, the two pore sub-clusters 125 are positioned such that non-porous portion 130 overlaps nozzle 50 (shown in broken lines in the plan view).

Experimental results included the following observations. Larger jet deflections (for example, in the X direction) are associated with a smaller separation distance H when compared to a larger separation distance H when one or more pores 110 of the pore cluster 120 become obstructed by particles. For a given separation distance H, the jet deflections associated with the pore cluster arrangement of FIG. 5B are generally lower in magnitude than the jet deflections associated with the pore cluster configuration of FIG. 5A. These lower levels are especially prevalent in the X direction which is typically associated with a relative movement direction of a recording medium 32 printed by printheads of the present invention. These lower levels are especially prevalent when a smaller separation distance H is used. In some cases, the jet deflections associated with the pore cluster 120 configuration of FIG. 5B are less than half of the jet deflections associated with the pore cluster 120 configuration of FIG. 5A. As a result, the pore cluster 120 configuration of FIG. 5B can be especially effective in reducing jet deflection levels when very small nozzle plate 49 to filter membrane 100 distances H are used. Whether using the pore cluster configuration shown in FIG. 5A or FIG. 5B, small nozzle plate 49 to filter membrane 100 separations includes nozzles having a width $D_N$ being spaced apart from the filter membrane by a distance H, where $0.5\ D_N<H<5\ D_N$ (i.e. $D_N$ being a size of a nozzle 50 as previously defined).

Although the present invention is not to be bound by any particular theories, observations as to why the pore cluster 120 configuration of FIG. 5B can reduce jet deflections caused by obstructions of pores 110 are discussed below. It is believed that perturbations in the continuous flow of liquid 52 have increased time and distance to settle out since the flow of liquid 52 approaching the non-porous portion 130 bends and travels a longer path to pass through the pores 110 of the adjacent pore sub-clusters 125.

Figure 6:
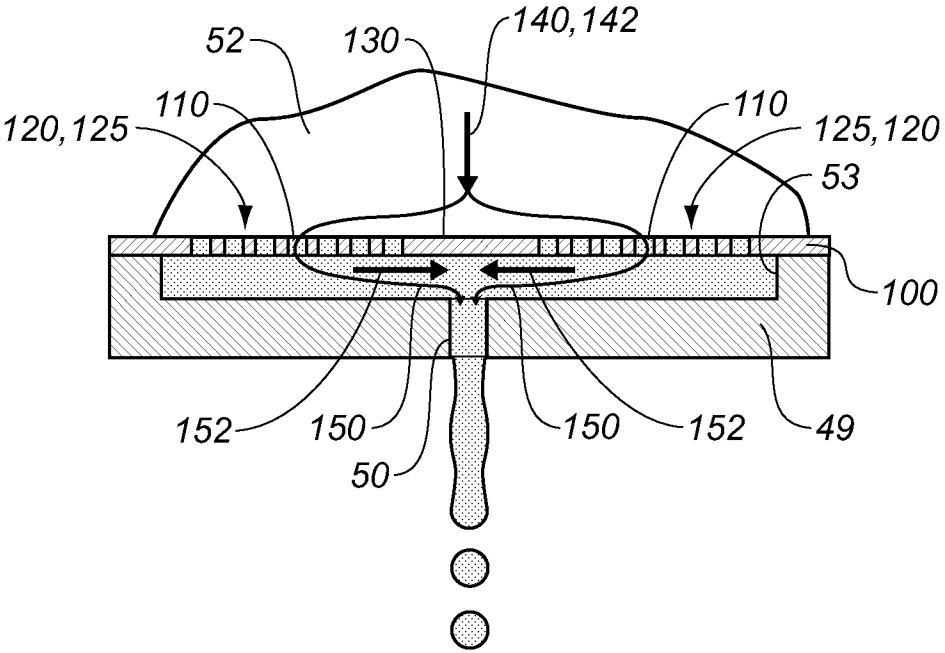
FIG. 6 shows flow conditions of a liquid as it flows through a filter membrane having the pore configuration of FIG. 5B.

Referring to FIG. 6, it is believed that the continuous flow of liquid 52 is directed towards filter membrane 100 such that a portion of the liquid 52 flows along a first path 140 as the liquid portion approached the filter membrane 100. In this case, the first path 140 extends along a first direction 142 that intersects an inlet of nozzle 50. Non-porous portion 130 is positioned to intercept the continuous flow of liquid 52 and redirect the portion of liquid 52 away from first path 140 and cause the portion of liquid 52 to enter various ones of the pores 110 in the filter membrane 100. The portion of the liquid 52 enters liquid chamber 53 and is redirected along a second path 150 that has a directional component 152 that intersects first direction 142. Accordingly, a symmetrical positioning of the pore sub-clusters 125 relative to nozzle 50 can cause substantially equal and opposing directional flows of liquid 52 within liquid chamber 53. The opposing directional flows can create a strong bias in the flow characteristics which overcomes any perturbations in the flow caused by an obstruction of one or more of the pores 110.

Without limitation, other causes can additionally or alternatively contribute to these effects. The use of particular pore cluster 120 configuration in example embodiments of the invention can be motivated by different reasons including a desired nozzle plate 49 to filter membrane 100 separation distance H. In some example embodiments, a particular pore cluster 120 configuration is employed based at least on a nozzle plate 49 to filter membrane 100 separation, H where H is selected from a range defined by $0.5\ D_N<H<5\ D_N$ (i.e. $D_N$ being a size of a nozzle 50 as previously defined).

Figure 7:
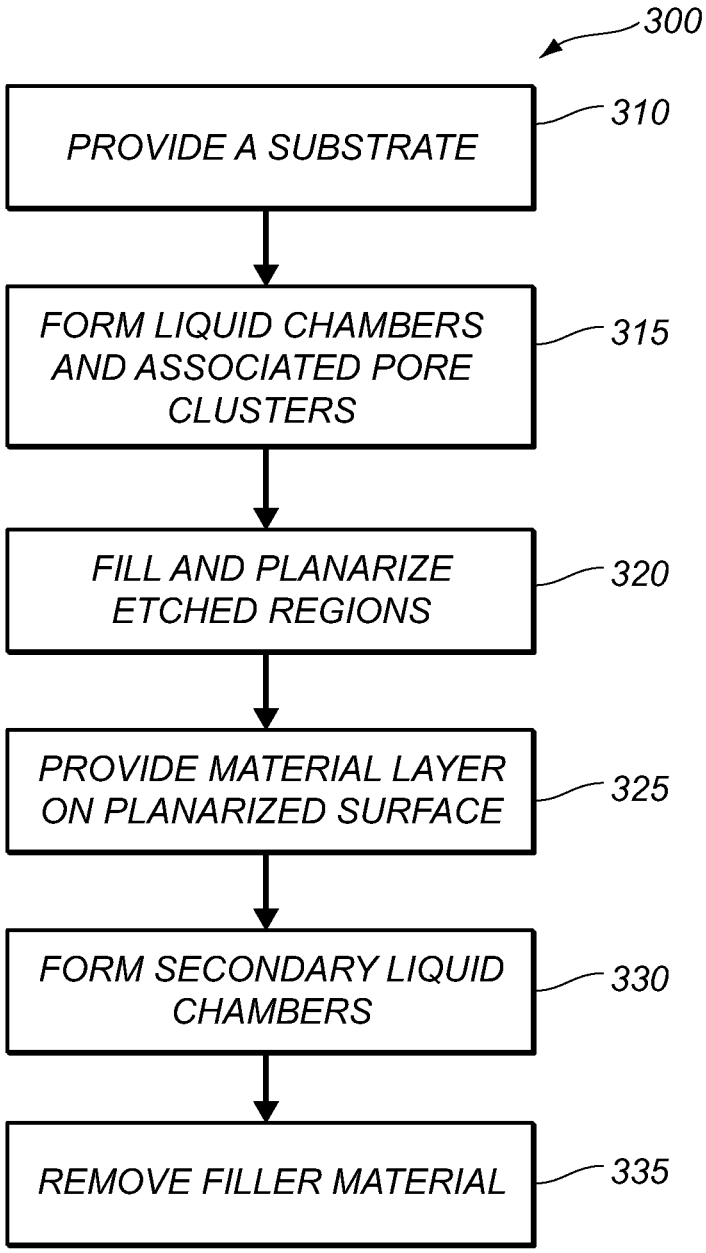
FIG. 7 is a flow chart representing a method for manufacturing an integrated filter membrane/nozzle plate unit in accordance with an example embodiment of the invention.
Figure 8A:
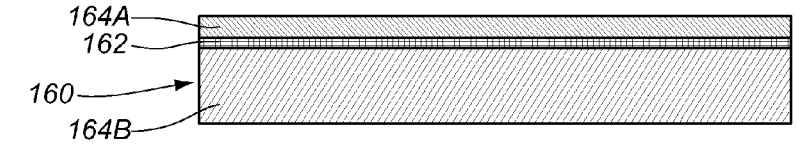
FIGS. 8A through 8F show processing stages in the formation of an integrated filter membrane/nozzle plate unit according to the method described in FIG. 7 with FIG. 8F also showing a cross-sectional side view of a jetting module including another example embodiment of the present invention.
Figure 8B:
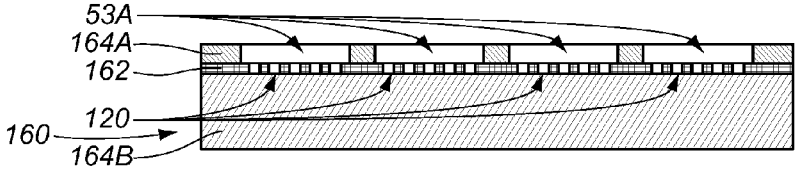

FIG. 7 shows a flow chart representing a method 300 for manufacturing an integrated nozzle plate 49/filter membrane 100 unit in accordance with an example embodiment of the invention. Various processes steps associated with the method represented by the FIG. 7 flow chart are additionally schematically illustrated in FIGS. 10A, 10B, 10C, 10D, 10E, and 10F for convenience. In step 310, a substrate 160 is provided as illustrated in FIG. 8A. In this example embodiment, substrate 160 includes a semiconductor material (e.g. silicon). Substrate 160 includes an etch stop layer 162 positioned between the two semi-conductor layers 164A and 164B. One example of such an integrated substrate is a silicon-on-insulator substrate (SOI). In step 315, patterning and etching techniques are used to form liquid chambers 53A in semiconductor layer 164A and associated pore clusters 120 in etch stop layer 162. This can include masking layer 164A to define pore structure using a positive resist. DRIE etching layer 164A for a period of time. Then expose and develop the same photoresist to define the larger liquid chamber regions. DRIE etch the chamber regions. The regions that previously had been etched with the pore structure will continue to be etched at about the same rate as the chamber regions to keep about the same height differential. The DRIE etching continues until the pore regions have been etched through to the insulator layer. Layer 162 can then be etched through the DRIE etched pores in layer 164A, to define pores in layer 162. The wafer can then be returned to DRIE etch the liquid chambers down to the insulator layer. The photoresist is then removed from layer 164A.

Figure 8C:
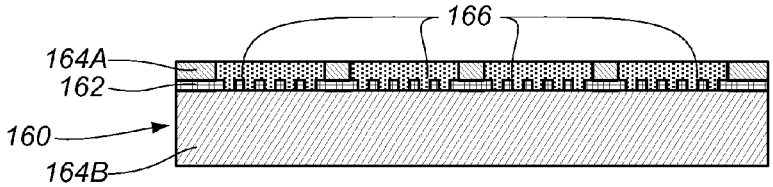
Figure 8D:
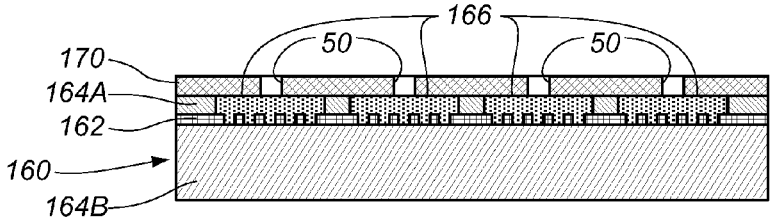
Figure 8E:
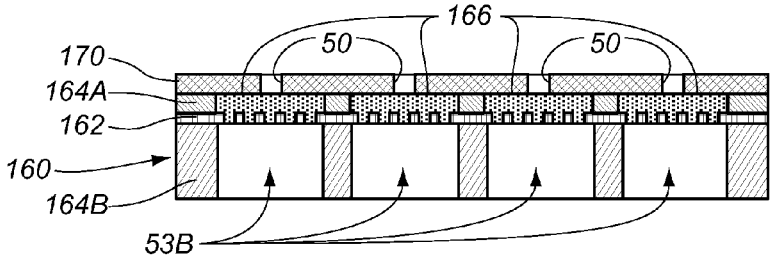

In step 320, the regions of substrate 160 that were etched in step 315 are filled with filler material 166, for example, polyimide, and planarized as illustrated in FIG. 8C. In step 325, a material layer 170 is deposited on the planarized surface of substrate 160. The deposited material layer 170 is subsequently patterned and etched to form a plurality of nozzles 50 as shown in FIG. 8D. Step 325 can also include the fabrication of drop forming devices 28, which can include heaters 51, adjacent to the nozzles 50. Exemplary steps for depositing the material layer 170 and forming the nozzles 50 and associated drop forming devices 28 are described in U.S. Pat. No. 6,943,037, which is incorporated by reference herein.

Figure 8F:
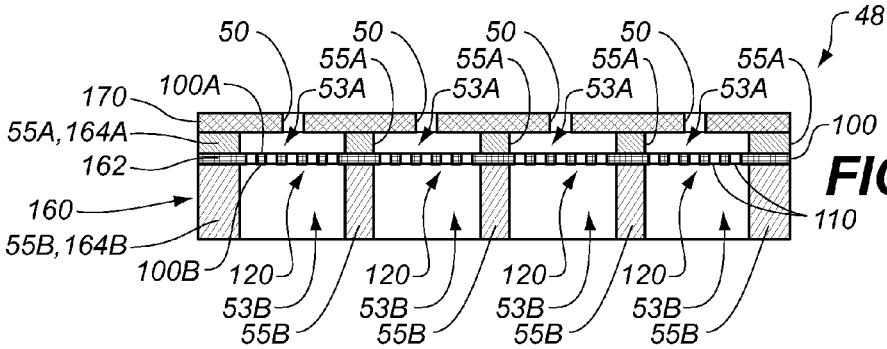

In step 330, one or more secondary liquid chambers 53B are patterned and etched into semiconductor layer 164B. Liquid chambers 53B are positioned upstream of pore clusters 120 relative to anticipated flow direction of liquid within the printhead. Liquid channels 53B provide fluid communication between the liquid source, for example, ink source, and the filter membrane, while the walls 55B in layer 164B provide structural support. In some embodiments, a single liquid chamber 53B spans the entire nozzle array and provides fluid communication between the ink source and the pore clusters 120 associated with each of the nozzles. In step 335, filler material 166 is removed to complete the integrated nozzle plate/filter membrane unit as shown in FIG. 8F. It is noted that manufacturing method 300 is presented by way of example only and additional and/or alternate steps or additional and/or alternate sequences of steps are within the scope of the present invention.

Referring to FIG. 8F, and back to FIG. 4A, another example embodiment of the present invention is shown. Jetting module 48 includes a filter 100 adapted for filtering particulate matter from the continuous flow of liquid 52. In particular, jetting module 48 includes filter membrane 100. Filter membrane 100 is adapted for filtering portions of the continuous flow of liquid 52 that is provided by channel 47 (shown in FIG. 4A). Filter membrane 100 includes a plurality of pores 110 positioned relative to each other to create pore cluster 120. Pores 110 and pore cluster 120 are adapted for filtering particulate matter in the continuous flow of liquid 52.

Jetting module 48 includes a plurality of liquid chambers 53A, each of the liquid chambers 53A providing a portion of liquid 52 to a respective one of nozzles 50. In this example embodiment, filter membrane 100 is separated from nozzles 50 by the plurality of liquid chambers 53A. The liquid chambers 53A provide for fluid communication between nozzles 50 and pores 110 of pore cluster 120. Each liquid chamber 53 can be positioned for fluid communication with a different one of the plurality of nozzles 50.

In this example embodiment, filter 100 includes a first side 100A and a second side 100B that is upstream relative to a direction of fluid flow and first side 100A. In this embodiment, the plurality of walls 55 are a first plurality of walls 55A that extend to the first side 100A of the filter 100. A second plurality of walls 55B extend from the second side 100B of the filter 100 toward channel 47 (shown in FIG. 4A).

Referring to FIG. 8F, each liquid chamber 53A is positioned for fluid communication with a single different one of the nozzles 50. Each liquid chamber 53A is defined by a walled enclosure at least partially defined by wall(s) 55A. Each wall 55A extends from substrate 85 to filter membrane 100 and helps define liquid chambers 53A that are positioned between substrate 85 and filter membrane 100. In addition to being in fluid communication with a respective one of the plurality of nozzles 50, each liquid chamber 53A of the plurality of liquid chambers 53A is in fluid communication with a plurality of pores 110 of a respective one of the plurality of pore clusters 120, described in more detail above, of filter 100.

The second plurality of walls 55B define a plurality of liquid feed channels 53B with each of the liquid feed channels 53B being in fluid communication through one of the plurality of pore clusters 120 with a respective one of the plurality of liquid chambers 53A. The liquid feed channels 53B and the liquid chambers 53A can be substantially co-linear with the respective one of the plurality of nozzles 50. Liquid feed channels 53B are also in fluid communication with feed channel 47 (shown in FIG. 4A). Alternatively, each liquid feed channel 53B can be in fluid communication with a plurality of liquid chambers 53A through the pore cluster 120 associated with each liquid chamber 53A.

Figure 9A:
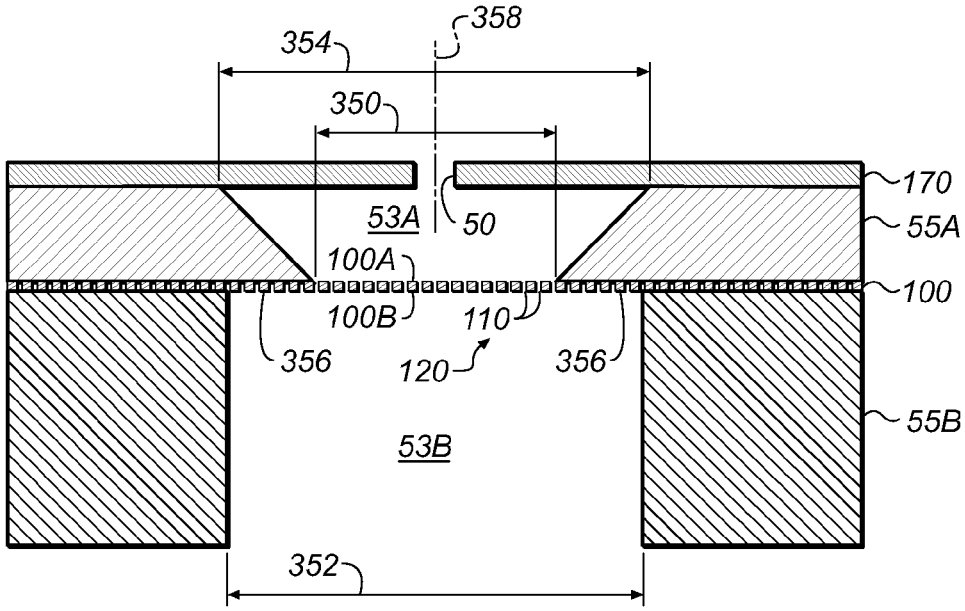
FIG. 9A is a cross-sectional side view of a jetting module including another example embodiment of the present invention.
Figure 9B:
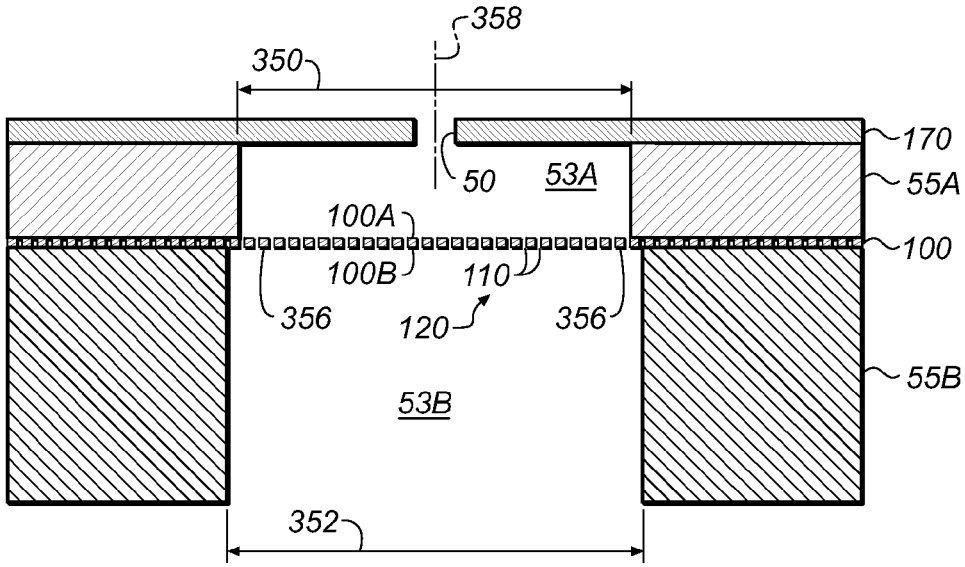
FIG. 9B is a cross-sectional side view of a jetting module including another example embodiment of the present invention.

Referring to FIGS. 11A and 11B, and back to FIGS. 10F and 4A, additional example embodiments of the present invention. The nozzles 50 are arranged in an array, typically, a one or two dimensional linear array. As shown in FIGS. 11A and 11B, the array of nozzles 50 extends into and out of each figure. Liquid chamber 53A includes a first width 350 that is measured perpendicular to an axis 358 of nozzles 50. Liquid feed channel 53B includes a second width 352 measured perpendicular to the nozzle axis 358. The first width 350 is different when compared to the second width 352. The first width 350 is smaller than the second width 352 which helps to define supports 356 that provide additional stability and rigidity to filter 100. As shown in FIG. 9A, liquid chamber 53A also includes a third width 354 that is measured perpendicular to the nozzle axis 358 and is downstream relative to the first width 352. Third width 354 is larger than first width 350. This helps to define supports 356 that provide adequate flow characteristics and increased contact area that contacts filter 100 (for example, when compared to the supports 356 shown in FIG. 9B). The liquid chamber 53A shown in FIG. 9A can be formed to produce the sloping walls 55A by means of an anisotropic etching of the silicon material by such etchants as KOH or tetramethylammonium (TMAH). While the example embodiments shown in FIGS. 10F, 11A, and 11B include the filter type shown in FIGS. 4A and 5A, alternative example embodiments include, for example, the filter type shown in FIGS. 4B and 5B.

Embodiments of the present invention advantageously allow for the formation of integrated nozzle plate/filter membrane units formed from a single substrate. Embodiments of the present invention advantageously allow for the use of MEMS fabrication techniques which can substantially lower particulate contamination associated with other manufacturing techniques. Embodiments of the present invention advantageously allow for the formation of integrated nozzle plate/filter membrane units with acceptable jet straightness.

The invention has been described in detail with particular reference to certain example embodiments thereof, but it will be understood that variations and modifications can be effected within the scope of the invention.

PARTS LIST

20 continuous inkjet printer system
22 image source
24 image processing unit
26 mechanism control circuits
28 drop forming device
30 printhead
32 recording medium
34 recording medium transfer system
36 recording medium control transfer system
38 micro-controller
40 reservoir
42 catcher
44 recycling unit
46 pressure regulator
47 channel
48 jetting module
49 nozzle plate
50 plurality of nozzles
51 heater
52 liquid
53 liquid chamber
53A liquid chamber
53B liquid channel
54 drops
55A wall
55B wall
56 drops
57 trajectory
58 drop stream
60 gas flow deflection mechanism
61 positive pressure gas flow structure
62 gas flow
63 negative pressure gas flow structure
64 deflection zone
66 small drop trajectory
68 large drop trajectory
72 first gas flow duct
74 lower wall
76 upper wall
78 second gas flow duct
82 upper wall
84 seals
85 substrate
86 liquid return duct
87 substrate
88 plate
90 face
92 positive pressure source
94 negative pressure source
96 wall
98 semiconductor material
100 filter membrane
110 pores
120 pore cluster
125 pore sub-cluster
130 non-porous portion
140 first path
142 first direction
150 second path
152 directional component
160 substrate
162 etch stop layer
164A semiconductor layer
164B semiconductor layer
166 filler material
170 material layer
200 conventional continuous inkjet printhead
249 nozzle plate
250 nozzles
252 liquid
253 streams
255 liquid chamber
260 liquid supply manifold
270 filter
280 pores
300 method
310 provide a substrate
315 form liquid chambers and associated pore clusters
320 fill and planarize etched regions
325 provide material layer on planarized surface
330 form secondary liquid chambers
335 remove filler material
350 first width
352 second width
354 third width
356 support
X axis
Y axis
W distance
L distance
$D_N$ nozzle size
H separation

The invention claimed is:

1. A printhead comprising:

a nozzle plate, portions of the nozzle plate defining a plurality of nozzles;

a filter membrane including a plurality of pores grouped in a plurality of pore clusters; and a plurality of walls, each of the plurality of walls extending from the nozzle plate to the filter membrane to define a plurality of liquid chambers positioned between the nozzle plate and the filter membrane, each liquid chamber of the plurality of liquid chambers being in fluid communication with a respective one of the plurality of nozzles, each liquid chamber of the plurality of liquid chambers being in fluid communication with the plurality of pores of a respective one of the plurality of pore clusters, the respective one of the plurality of pore clusters including two pore sub-clusters spaced apart from each other by a non-porous portion of the filter membrane.

2. The printhead of claim 1, wherein the two pore sub-clusters are symmetrically located relative to the respective one of the plurality of nozzles.

3. The printhead of claim 1, the filter membrane including a first side and a second side, the plurality of walls being a first plurality of walls that extend to the first side of the filter membrane, the printhead further comprising:

a second plurality of walls extending from the second side of the filter membrane to define a plurality of liquid feed channels, each liquid feed channel being in fluid communication through one of the plurality of pore clusters with a respective one of the plurality of liquid chambers.

4. The printhead of claim 3, wherein each of the plurality of liquid feed channels and each of the plurality of liquid chambers are substantially co-linear with the respective one of the plurality of nozzles.

5. The printhead of claim 1, each nozzle of the plurality of nozzles having an area, each pore of the plurality of pores having an area, wherein the area of each pore is less than half of the area of each nozzle.

6. The printhead of claim 1, each nozzle of the plurality of nozzles having a width $D_N$, the filter membrane being spaced apart from the plurality of nozzles by a distance H, where $0.5\ D_N<H<5\ D_N$.

7. The printhead of claim 1, wherein each of the plurality of pores have the same size and shape.

8. The printhead of claim 1, wherein the pores of the pore cluster are parallel relative to the respective one of the plurality of nozzles.

9. The printhead of claim 1, wherein the filter membrane is made from a first material and the plurality of walls are made from a second material, the second material being different from the first material.

10. The printhead of claim 9, the filter membrane having a thickness in the direction of liquid travel, the thickness being selected such that the pressure drop through the plurality of pores of the pore cluster is less than ⅕ of the pressure drop through the nozzle.

11. The printhead of claim 1, the nozzle plate including a substrate, portions of the nozzle plate substrate defining the plurality of nozzles, each of the plurality of walls extending from the nozzle plate substrate that includes the plurality of nozzles to the filter membrane to define a plurality of liquid chambers positioned between the nozzle plate substrate and the filter membrane.

12. A printhead comprising:

a nozzle plate, portions of the nozzle plate defining a plurality of nozzles;

a filter membrane including a plurality of pores grouped in a plurality of pore clusters; and a plurality of walls, each of the plurality of walls extending from the nozzle plate to the filter membrane to define a plurality of liquid chambers positioned between the nozzle plate and the filter membrane, each liquid chamber of the plurality of liquid chambers being in fluid communication with a respective one of the plurality of nozzles, each liquid chamber of the plurality of liquid chambers being in fluid communication with the plurality of pores of a respective one of the plurality of pore clusters, the respective one of the plurality of pore clusters including two pore sub-clusters spaced apart from each other by a non-porous portion of the filter membrane, wherein the non-porous portion of the filter membrane is aligned with the respective one of the plurality of nozzles such that none of the plurality of pores of the respective one of the plurality of pore clusters is co-linear with the respective one of the plurality of nozzles.

13. A printhead comprising:

a nozzle plate, portions of the nozzle plate defining a plurality of nozzles;

a filter membrane including a plurality of pores grouped in a plurality of pore clusters;

a plurality of walls, each of the plurality of walls extending from the nozzle plate to the filter membrane to define a plurality of liquid chambers positioned between the nozzle plate and the filter membrane, each liquid chamber of the plurality of liquid chambers being in fluid communication with a respective one of the plurality of nozzles, each liquid chamber of the plurality of liquid chambers being in fluid communication with the plurality of pores of a respective one of the plurality of pore clusters, the respective one of the plurality of pore clusters including two pore sub-clusters spaced apart from each other by a non-porous portion of the filter membrane; and a liquid source in liquid communication with each nozzle of the plurality of nozzles through each liquid chamber and the respective one of the plurality of pore clusters associated with each liquid chamber, the liquid source being configured to provide liquid under pressure sufficient to eject a jet of liquid through each nozzle.

* * * * *